US005687449A

United States Patent [19]

Zachay et al.

[11] Patent Number: 5,687,449

[45] Date of Patent: Nov. 18, 1997

[54] SOOT BLOWER UNIT

[75] Inventors: Richard Zachay, Voerde; Karl Albers, Wesel, both of Germany

[73] Assignee: Bergemann GmbH, Wesel, Germany

[21] Appl. No.: 559,934

[22] Filed: Nov. 17, 1995

[30] Foreign Application Priority Data

Dec. 3, 1994 [DE] Germany ..... 44 43 128.7

[51] Int. Cl.[6] ..... A47L 5/38

[52] U.S. Cl. ..... 15/316.1; 15/312.1

[58] Field of Search ..... 15/312.1, 316.1, 15/317, 318; 122/380, 384, 390, 391; 165/95

[56] References Cited

U.S. PATENT DOCUMENTS

| | | | |
|---|---|---|---|
| 2,089,710 | 8/1937 | Reekie | 15/316.1 |
| 4,380,843 | 4/1983 | Sullivan et al. | 15/316.1 |
| 4,387,481 | 6/1983 | Zalewski | 15/316.1 |

FOREIGN PATENT DOCUMENTS

| | | | |
|---|---|---|---|
| 59-107114 | 6/1984 | Japan | 15/316.1 |
| 1-217116 | 8/1989 | Japan | 15/316.1 |
| 970140 | 9/1964 | United Kingdom | 15/317 |

*Primary Examiner*—David Scherbel
*Assistant Examiner*—Terrence R. Till
*Attorney, Agent, or Firm*—Max Fogiel

[57] ABSTRACT

A soot blower unit with an axially moved soot blower for the cleaning of heating surfaces of a heat exchanger (1) consists of a lance tube (4) and of a travel carrier (11), which is provided with a track rail (9) and fastened at the wall (2) of the heat exchanger (1). The lance tube (4) is guided at its forward end in a lance tube guide (15) and connected at its rearward end with a blower carriage (7), which is movable on the track rail (9). The vertical spacing of the track rail (9) of the travel carrier (11) from the forward end ($h_1$) of the lance tube (4) is less than from the rearward end ($h_2$), which is retained by the blower carriage (7), of the lance tube (4).

4 Claims, 4 Drawing Sheets

SOOT BLOWER UNIT

BACKGROUND OF THE INVENTION

The present invention concerns a soot blower unit with an axially moved soot blower for the cleaning of heating surfaces of a heat exchanger.

During the moving into the heat exchanger, the lance tube of the soot blower sags down by reason of its own weight. The danger thereby arises that, in the case of tube nests lying one closely above the other, the nozzle head of the lance tube hits the nest tubes and damages them. Due to too small a spacing between the nozzle head and nest tube, it can come to erosions at the nest tubes. It is known, for the avoidance of such damage, to armor the nest tubes in the region of the travelling path of the lance tube. It is furthermore known to correct the path of the lance tube by the rear end of the lance tube when lowered. The travel track, at which the blower carriage is guided along for the drive of the lance tube, displays a kinked course. Such an arrangement is connected with an increased constructional expenditure, since the course of the travel track must be matched to the structuring of the tube nests in the heat exchanger and to the material, of which the lance tube is made. A merely simple raising of the lance tube at the lance tube guide would in the case of a rectilinear course of the travel track, have the consequence that the nozzle head would also be displaced upwardly. In that case, the nozzle head would however no longer be introduced centrally through the wall opening into the heat exchanger and could hit against the tubes within the heat exchanger.

SUMMARY OF THE INVENTION

The present invention is based on the object of so structuring the soot blower unit that a path correction of the lance tube can be achieved by simple means.

In the soot blower unit according to the present invention, the lance tube guide of the lance tube is arranged in a fixed spatial relationship to the heat exchanger this relationship is settable before putting the soot blower unit into operation. The nozzle head of the lance tube is therefore always centered when entering into the heat exchanger. In the rest setting of the soot blower, the rear end of the lance tube has a greater spacing from the track rail than the front end of the lance tube. According to the respective setting of the travel carrier, the front end, which is supported by the lance tube guide, of the lance tube is thereby set horizontally, obliquely upwards or obliquely downwards. On a moving-in of the lance tube, the nozzle head is raised for an always central introduction into the heat exchanger, whereby the setting angle is constantly increased with the travel path into the heat exchanger. This rising setting angle counteracts the increasing sagging of the lance tube. The travel path of the nozzle head can be set quite accurately by this correction so that the soot blower unit can also be used for heat exchangers with tube nests lying closely one above the other. The possibility of being able to adjust the spacing of the lance tube guide relative to the travel carrier compensates for deviations in the actual bending through of the lance tube. These deviations result from, for example, differences in the wall thickness of the lance tube, which can fluctuate within the scope of the permissible tolerances in the tube dimensions. The path curve, which the nozzle head describes during the advance of the lance tube, is measured before putting the soot blower unit into operation. The spacing between the lance tube guide and the travel carrier is so adjusted, once in proportion to this measurement, that the nozzle head does not contact the tubes of the heat exchanger, which are to be cleaned. When the travel carrier is articulatedly connected with the wall of the heat exchanger, it recommends itself to arrange the lance tube guide of the lance tube on an end plate connected with the joint and to fasten the travel carrier at the end plate while maintaining the aforedescribed spacings between track rail, lance tube guide and rear end of the lance tube.

In further advantageous refinement of the present invention, the soot blower unit can be arranged inclined towards the heat exchanger. In this manner, it is prevented that condensate, which would collect in the inner tube or in the lance tube, for example, by reason of a not quite tightly closing soot blower valve in the valve, flows away towards the heat exchanger and evaporates there. Damages at the nest tubes by thermal shock effect and erosions due to condensate blown in with the cleaning steam, are reduced appreciably. In that case, the nozzle head executes the aforedescribed movement, except for the setting angle of the lance tube in the rest setting, which is greater than for an horizontal arrangement of the travel carrier.

BRIEF DESCRIPTION OF THE DRAWINGS

An example of embodiment of the invention is illustrated in the drawing and more closely explained in the following. There show.

DESCRIPTION OF THE PREFERRED EMBODIMENTS

Figure 1:
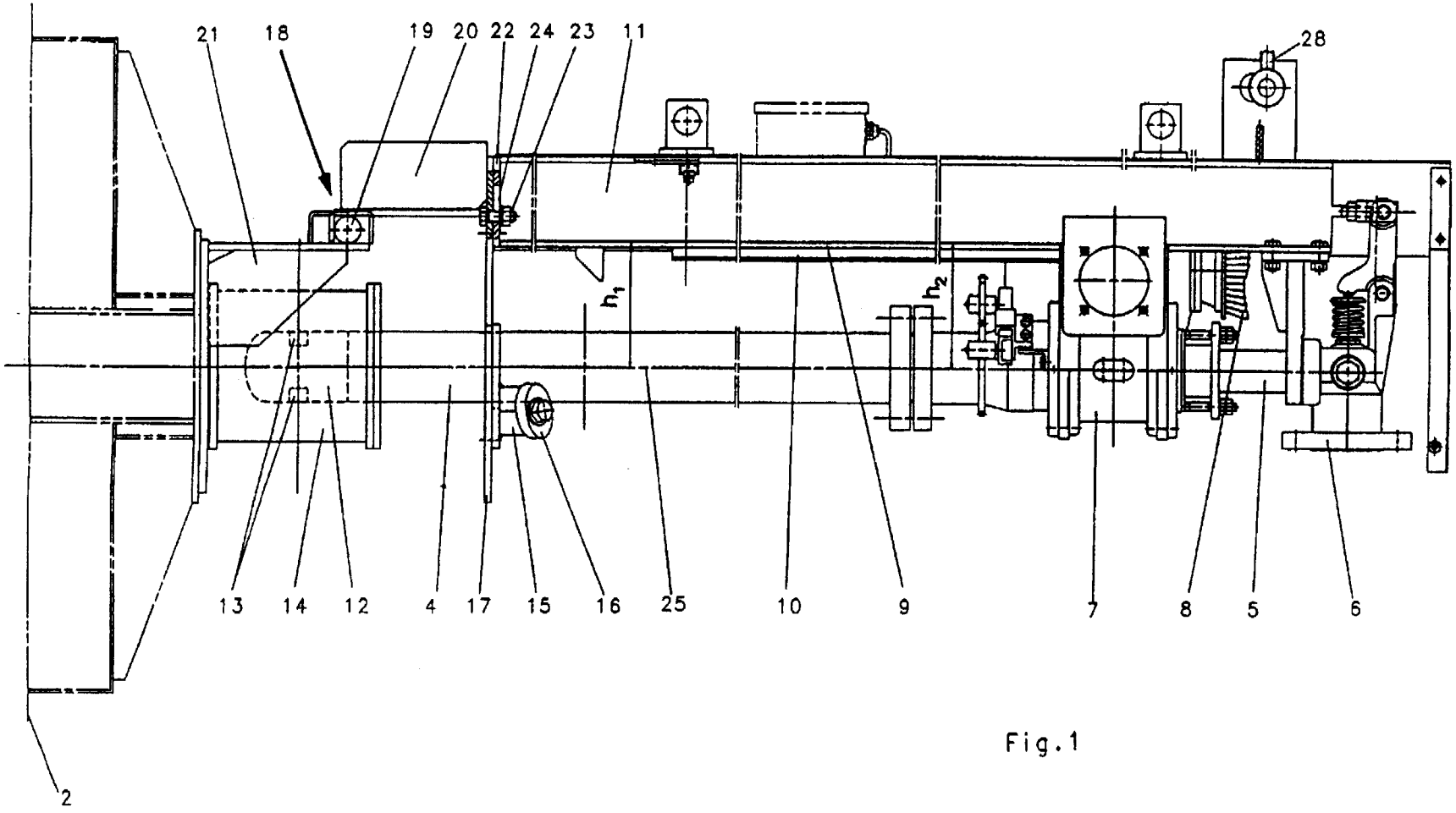
FIG. 1 is a side elevation of a soot blower unit without path correction.
Figure 2:
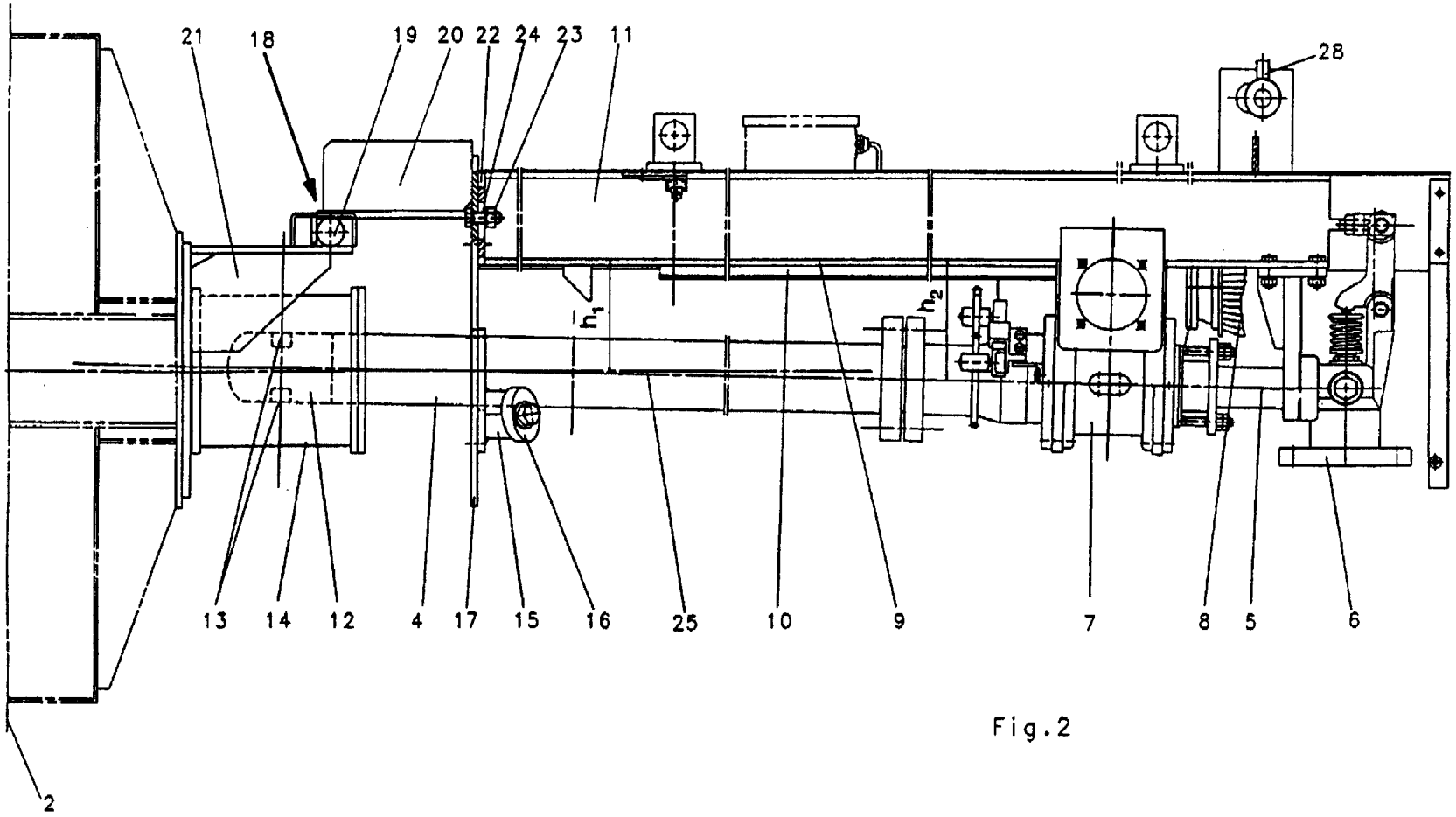
FIG. 2 is a side elevation of a soot blower unit with path correction.

The illustrated soot blower unit contains an axially moved soot blower which serves for the cleaning of heating surfaces in heat exchangers. Such a heat exchanger 1 can according to FIG. 4 be a pass of a boiler, which is bounded by walls 2 and in which heating surfaces constructed as tube nests 3 are accommodated.

The soot blower contains a lance tube, which engages over a stationary inner tube 5 and is guided at its rearward end by a blower carriage 7. The inner tube 5 is provided with a blower valve 6, through which a blowing medium, for example steam, is fed by way of the inner tube 5 to the lance tube 4. The lance tube 4 is connected with the blower carriage 7, which is driven by way of a motor 8 and movable on a track rail 9.

Pinions mounted on the drive output shaft of the motor 8 engage into toothed racks 10, which just as the track rail 9 are arranged on a travel carrier 11. On an actuation of the drive, the lance tube 4 executes a rectilinear, initially forwardly and subsequently rearwardly directed movement, in a given case, with simultaneous rotation about its longitudinal axis.

The tip of the lance tube 4 is constructed as nozzle head 12. The nozzle head 12 is provided on its circumference with several nozzles 13, from which the supplied steam issues radially. The nozzle head 12 is led through an opening in the wall 2 of the heat exchanger 1. The opening is sealed by a wall box 14. In normal operation of the heat exchanger 1 and in the rest setting of the soot blower, the nozzle head 12 is retracted into the wall box 14.

In the proximity of the wall 2, the lance tube 4 is guided in a lance tube guide 15. The lance tube guide 15 contains rollers 16, on which the lance tube 4 rests. The lance tube 4 is thereby guided at its forward end by this lance tube guide 15 and at its rearward end by the blower carriage 7.

The rearward end of the travel carrier 11 is connected, for example by way of a linkage 28, with the wall 2 of the heat exchanger 1 or with a frame surrounding the heat exchanger 1. The forward end of the travel carrier 11 is articulated to the wall 2 for the compensation for thermal expansions of the heat exchanger 1. In particular manner, this articulated connection consists of an additional, or second end plate 17, which is connected with the wall 2 by way of a joint 18. The joint 18 contains two straps 20 and 21, which are connected by a hinge pin 19 and of which the one (20) is fastened at the additional end plate 17 and the other (21) at the wall 2.

The travel carrier 11 is provided with a first end plate 22, which is connected with the additional end plate 17. Expediently, the connection of the end plates 17 and 22 takes place by way of threaded bolts 23, which pass through both end plates 17 and 22 and are tightened by nuts. In order to be able to align the travel carrier 11 relative to the additional end plate 17, also after its installation, the bores, through which the threaded bolts 23 are guided, in one of the end plates, for example in the first end plate 22, are formed as elongate holes 24. The travel carrier 11 is connected with the additional end plate 17 and by way of the first end plate 22 with the wall 2 of the heat exchanger The lance tube guide 15 with the rollers 16 for the guidance of the forward end of the lance tube 4 is fastened at the additional end plate 17. In that case, the lance tube guide 15 is arranged at such a height that the nozzle head 12 enters centrally into the wall box 14. The vertical spacing $h_1$ of the lance tube 4 from the track rail 9 is smaller than the vertical spacing $h_2$ of the rearward guided end of the lance tube 4 from the track rail 9.

Because bearing points of the lance tube 4 are arranged to differ in height relative to the track rail 9, the lance tube 4 and the track rail 9 are at an angle one to the other. The lance tube 4 points therefore obliquely upwards when the travel carrier 11 is arranged horizontally. When the lance tube 4 is now moved forwardly and into the heat exchanger 1 with the aid of the blower carriage 7, the nozzle head 12 points upwards with the formation of a setting angle. In that case, this setting angle becomes the greater, the further the lance tube 4 is advanced. Since the lance tube 4 on the other hand sags by its own weight, the further the sag is downwards, the greater is its free unsupported length the nozzle head 12 is to move an approximately horizontally extending path.

Figure 3:
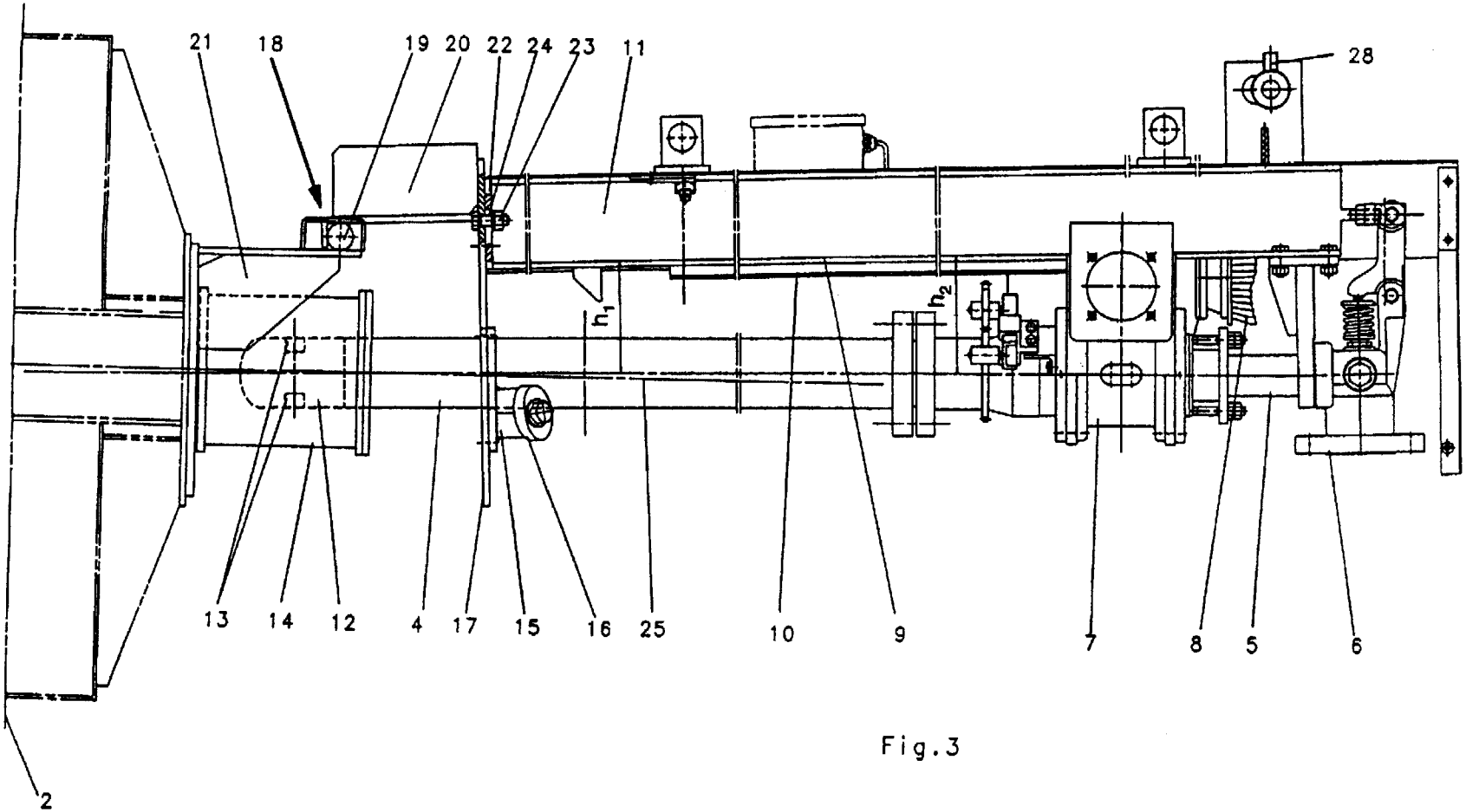
FIG. 3 is a side elevation of a soot blower unit with path correction and travel carrier arranged at an inclination to the heat exchanger wall, and FIG. 4 a heat exchanger with built-in soot blower unit.

The described principle of an enlarged setting angle due to the different spacings of the track rail 9 from the forward end of the lance tube 4, on the one hand, and from the rearward guided end of the lance tube 4, on the other hand, it lets itself be realized when the lance tube guide 15 of the lance tube 4 is not arranged on the additional end plate 17. This plate 17 is connected with the wall 2 by way of the joint 18, but directly at the heat exchanger 1. The same applies for the case that the travel carrier 11 is not horizontal, but inclined obliquely downwards according to FIG. 3. If condensate collects in the blower valve 6, the inner tube 5 or the lance tube 4 in this arrangement by reason of a leakage, the condensate can flow downwardly into the heat exchanger 1 and evaporate there. Damages due to thermal shock effect and erosions, which can arise due to condensate being blown in with the steam for the cleaning of the tube nests 3, are avoided in this manner.

Figure 4:
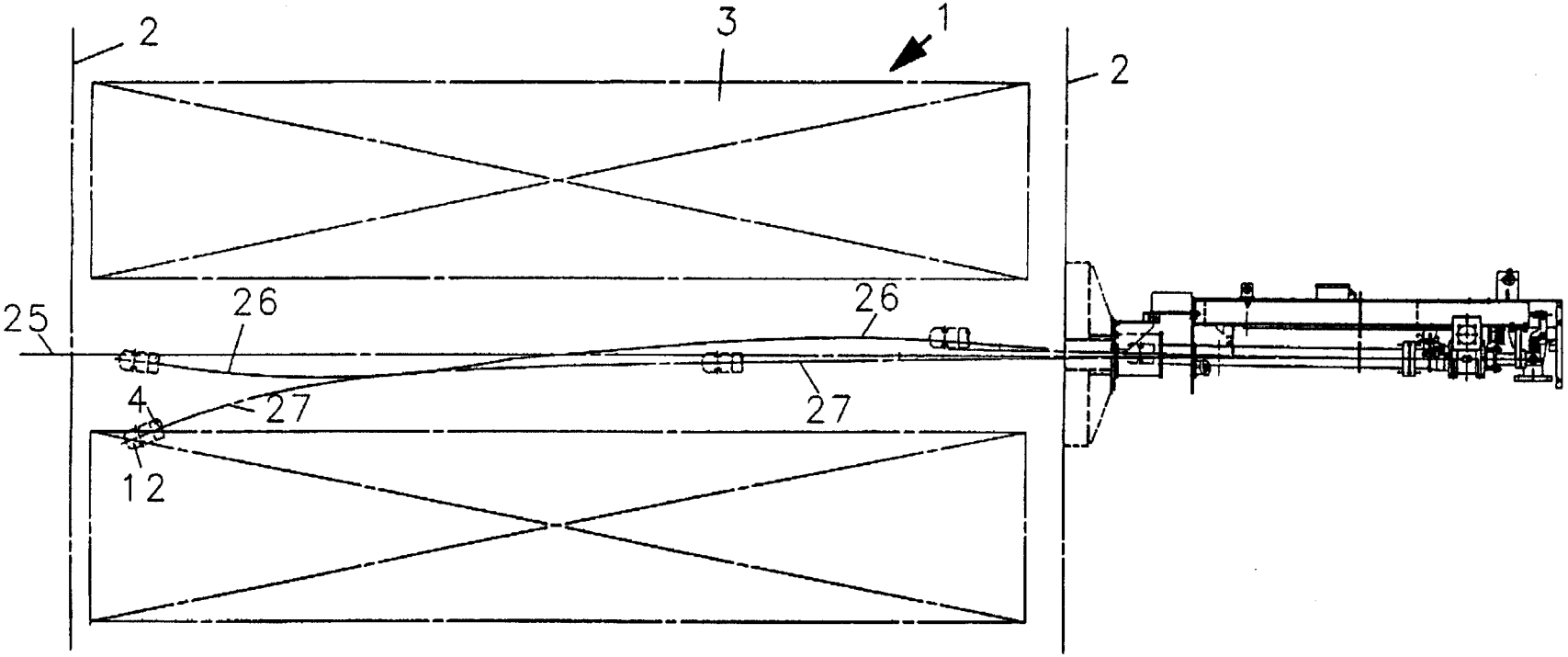

In the FIG. 4, the path curve of the nozzle head 12 is indicated, which the nozzle head 12 traverses when the lance tube 4 is moved into the heat exchanger 1 with an arrangement pointing obliquely upwards. One recognizes that a path 26 arises, which departs a little from the horizontal line 25 and for which the tube nests 3 are not touched. Without the path correction according to the present invention, a course of the path 27 would set itself, for which the nozzle head 12 hits the tube nest 3 at the end of the travel path, or the spacing between the nozzle head 4 and the nest tubes would have to become too small.

We claim:

1. A soot blower unit with an axially movable soot blower for cleaning heating surfaces of a heat exchanger, comprising: a lance tube and a travel carrier with a track rail; said travel carrier being secured to a wall of said heat exchanger; a blower carriage connected to a rear end of said lance tube and being movable on said track rail; said lance tube being driven from a rest position by said blower carriage axially into said heat exchanger; a lance tube guide, said lance tube having a front end guided into said lance tube guide; an end plate, said lance tube guide being secured to said wall of said heat exchanger through said end plate said lance tube guide being adjustably spaced from the travel carrier; said track rail of said travel carrier being vertically spaced by a first spacing from a front end of said lance tube in said rest position of said lance tube, said track rail of said travel carrier being vertically spaced by a second spacing from a rear end of said lance tube held by said blower carriage, said first spacing being less than said second spacing for forming an angle between said lance tube and said track rail.

2. A soot blower unit as defined in claim 1, including a joint secured to said wall of said heat exchanger; a hinge pin and two straps in said joint, said end plate being a first end plate; one of said straps being secured to said wall of said heat exchanger and said other strap being secured to said end plate carrying said lance tube guide; a second end plate on a front side of said travel carrier and connected to said first end plate; said track rail of said travel carrier being vertically spaced by a first spacing from a front end of said lance tube, said track rail being vertically cally spaced by a second spacing from a rear end of said lance tube held by said blower carriage, said first spacing being less than said second spacing.

3. A soot blower unit according to claim 1, including end plates connected by screws passed through elongated holes in one of said end plates.

4. A soot blower unit according to claim 1, wherein said lance tube is inclined and a forward end of said lance tube points downwards.

* * * * *